US008033323B2

(12) United States Patent
Schatz et al.

(10) Patent No.: US 8,033,323 B2
(45) Date of Patent: Oct. 11, 2011

(54) HEAT EXCHANGER

(75) Inventors: Harald Schatz, Reutlingen (DE); Stefan Muller-Lufft, Leonberg (DE); Heitel Ingo, Stuttgart (DE); Omur Acar, Neu-Ulm (DE); Jorg Soldner, Ehningen (DE); Michael Daniel, Neuhausen (DE); Bjorn Volquardsen, Boblingen (DE)

(73) Assignee: Modine Manufacturing Company, Racine, WI (US)

( * ) Notice: Subject to any disclaimer, the term of this patent is extended or adjusted under 35 U.S.C. 154(b) by 1106 days.

(21) Appl. No.: 11/764,491

(22) Filed: Jun. 18, 2007

(65) Prior Publication Data

US 2008/0006398 A1 Jan. 10, 2008

(30) Foreign Application Priority Data

Jun. 22, 2006 (DE) ..... 10 2006 028 578

(51) Int. Cl.
*F28F 7/00* (2006.01)
*F28F 9/00* (2006.01)

(52) U.S. Cl. ..... 165/69; 165/162

(58) Field of Classification Search ..... 165/69, 165/157, 159, 161, 162
See application file for complete search history.

(56) References Cited

U.S. PATENT DOCUMENTS

| | | | | |
|---|---|---|---|---|
| 1,304,496 | A * | 5/1919 | Blanding | 122/269 |
| 1,655,086 | A * | 1/1928 | Blanding | 165/163 |
| 1,803,035 | A * | 4/1931 | Potter | 165/161 |
| 2,070,427 | A * | 2/1937 | Faunce | 165/146 |
| 2,873,098 | A * | 2/1959 | Morgan | 165/159 |
| 3,804,161 | A | 4/1974 | Nowak | |
| 4,215,745 | A * | 8/1980 | Tuckmantel | 165/160 |
| 4,733,722 | A * | 3/1988 | Forbes et al. | 165/159 |
| 4,768,585 | A * | 9/1988 | Hayes et al. | 165/162 |
| 4,834,173 | A | 5/1989 | Weiss et al. | |
| 5,388,638 | A | 2/1995 | Gentry | |
| 5,644,842 | A * | 7/1997 | Coleman | 29/890.053 |
| 5,915,472 | A * | 6/1999 | Takikawa et al. | 165/158 |
| 6,244,256 | B1 | 6/2001 | Wall et al. | |

(Continued)

FOREIGN PATENT DOCUMENTS

CN 1685192 10/2005

(Continued)

OTHER PUBLICATIONS

Office Action from SIPO for Chinese Application 200710106787.X dated Mar. 11, 2010 (7 pages—English Translation).

*Primary Examiner* — Tho V Duong
(74) *Attorney, Agent, or Firm* — Michael Best & Friedrich LLP

(57) ABSTRACT

The invention relates to a heat exchanger having a bundle of tubes, which can be inserted into a tubular housing. Exhaust gas can flow through the tubes. A coolant duct can be arranged between the tubes. The bundle of tubes can have at least one grid-like securing structure which supports the bundle in the housing. The behavior of the heat exchanger with respect to vibrations is improved by virtue of the fact that the grid-like metallic securing structure includes integral hook-shaped protrusions which are deformed in the opposite direction to the insertion direction of the bundle into the housing. The spring force is directed against the housing in order to dampen vibrations. The heat exchanger can also include an elastic device for permitting a change in length caused by temperature changes.

27 Claims, 6 Drawing Sheets

U.S. PATENT DOCUMENTS

| | | | |
|---|---|---|---|
| 7,171,956 | B2 | 2/2007 | Igami et al. |
| 7,380,544 | B2 | 6/2008 | Raduenz et al. |
| 2006/0231243 | A1 | 10/2006 | Sugihara et al. |
| 2008/0006398 | A1 | 1/2008 | Schatz et al. |
| 2008/0202724 | A1 | 8/2008 | Lorenz et al. |
| 2008/0202739 | A1 | 8/2008 | Barfknecht et al. |

FOREIGN PATENT DOCUMENTS

| | | |
|---|---|---|
| CN | 1761809 | 4/2006 |
| DE | 2339364 | 2/1975 |
| DE | 3242619 | 6/1983 |
| DE | 3811961 | 6/1989 |
| DE | 19721132 | 11/1997 |
| DE | 10157285 | 6/2003 |
| DE | 10312788 | 9/2004 |
| EP | 1348924 | 10/2003 |
| EP | 1544564 | 6/2005 |
| EP | 1548386 | 6/2005 |
| WO | WO 03/ 001650 | 1/2003 |
| WO | WO 03/ 036214 | 5/2003 |
| WO | WO 03/ 064953 | 8/2003 |

* cited by examiner

HEAT EXCHANGER

FIELD OF THE INVENTION

The present invention relates to a heat exchanger, such as, for example, an exhaust gas heat exchanger.

SUMMARY

An exhaust gas heat exchanger is known from EP 1 348 924 A2 and from EP 1 544 564 A1. These heat exchangers have essentially fulfilled their intended functions. However, recently, exhaust gas mass flows, and also exhaust gas temperatures of motor vehicle engines and consequently also the thermal stresses experienced by exhaust gas coolers have risen. These changes can cause fractures and similar damage caused by excessively high temperature change stresses and can result in the system failing.

Consideration has also been given to improving exhaust gas heat exchangers in terms of their ability to withstand temperature change stresses. Such a solution is known, for example, from WO 03/036214A1. In this document, slits and a folding bellows have been arranged in the housing, as a result of which, the expansion behavior of the individual parts of the exhaust gas heat exchanger can be reliably improved. WO 03/064953 has, on the other hand, provided an expansion bead in the housing casing. WO 2003/01650 has proposed a sliding seat arrangement. All these solutions appear to be expedient without, however, being able to meet all of the requirements of current applications.

DE 32 42 619 A1 also discloses a heat exchanger having a grid-like securing structure, which performs the function of directing or influencing the flow in the housing. Furthermore, elastic elements are provided on the securing structure which are intended to compensate, and can compensate for the specific tolerances in the housing into which the tube bundle is inserted. For this reason, they are formed from a suitable plastic material which can be deformed in the wide regions and which therefore permits relatively large tolerance ranges. The elastic elements are attached to the securing structure, which is made of metal. The vibration-damping properties of the elastic element may be present but they are not sufficiently effective. Furthermore, in particular, in heat exchangers with a considerable length, vibrations which can only be adequately dealt with by means of the known elastic elements which occur at other locations. U.S. Pat. No. 3,804,161 also discloses heat exchangers.

In some embodiments, the present invention provides a heat exchanger which can make a contribution to solving one or more of the problems outlined above. The present invention can also or alternatively reduce vibration levels.

Because a grid-like metallic securing structure is embodied in one piece with elastic hook-shaped protrusions which point toward the inside of the housing and which are deformed in the opposite direction to the insertion direction of the bundle into the housing and whose spring force is directed against the housing in order to reduce the vibration level, and because a device which permits and compensates for changes in length and which has elastic properties is embodied and provided by the present invention, vibrations of the bundle in the housing can be significantly reduced and/or damped. The changes in length or changes in shape are induced by changes in temperature which occur during the operation of the heat exchanger. In principle, the natural frequency of the bundle is raised.

The deformed elastic hook-shaped protrusions can project over the cross-sectional surface of the housing before the bundle is inserted into the housing. When it is inserted, the elastic hook-shaped protrusions can be elastically deformed counter to the spring force in order to fit into the housing and in order then to apply this spring force against the inside of the housing.

Alternative proposals for a solution are provided by individual elastic metallic hook-shaped protrusions or springs which are attached to a metallic securing structure or between two metallic securing structures.

Within the scope of their investigations, the inventors have arrived at the conclusion that, in some applications, it is insufficient to provide such elastic, metallic hook-shaped protrusions or springs or the like. For this reason, they additionally provide a device which compensates for changes in length of the bundle and of the housing which are induced by changes in temperature, and they also embody this device with elastic properties in order to promote the vibration reducing property of the entire device.

In some embodiments, the present invention also provides for the housing to be composed of aluminium and to be embodied as a cast part into which the bundle, which can be a stainless steel soldered structure, can be inserted with tube plates, which are provided on the tube ends, and a diffuser.

The housing can have a connecting flange which can be matched to the diffuser, the device which permits changes in length having an elastic seal between the diffuser and the connecting flange.

In some embodiments, the present invention can include an elastic seal arranged in at least one groove, or alternatively, positioned to fill substantially the entire region between the diffuser and connecting flange.

In some embodiments, the present invention provides at least one clamping element, which extends through the bundle and is arranged between two grid-like securing structures in order to dampen vibrations. In some such embodiments, a device which permits changes in length and which has elastic properties is also provided.

The tubes can be constructed as flat tubes which can be composed of pairs of plates and/or can be manufactured from a sheet metal strip and welded to a longitudinal seam. Round tubes which extend as tube bundles straight through the heat exchanger in a manner similar to that shown in DE 32 42 619 A1 can also or alternatively be used. However, in order to improve the exchange of heat, these tubes can have a twist which provides the tube wall with a corrugation.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
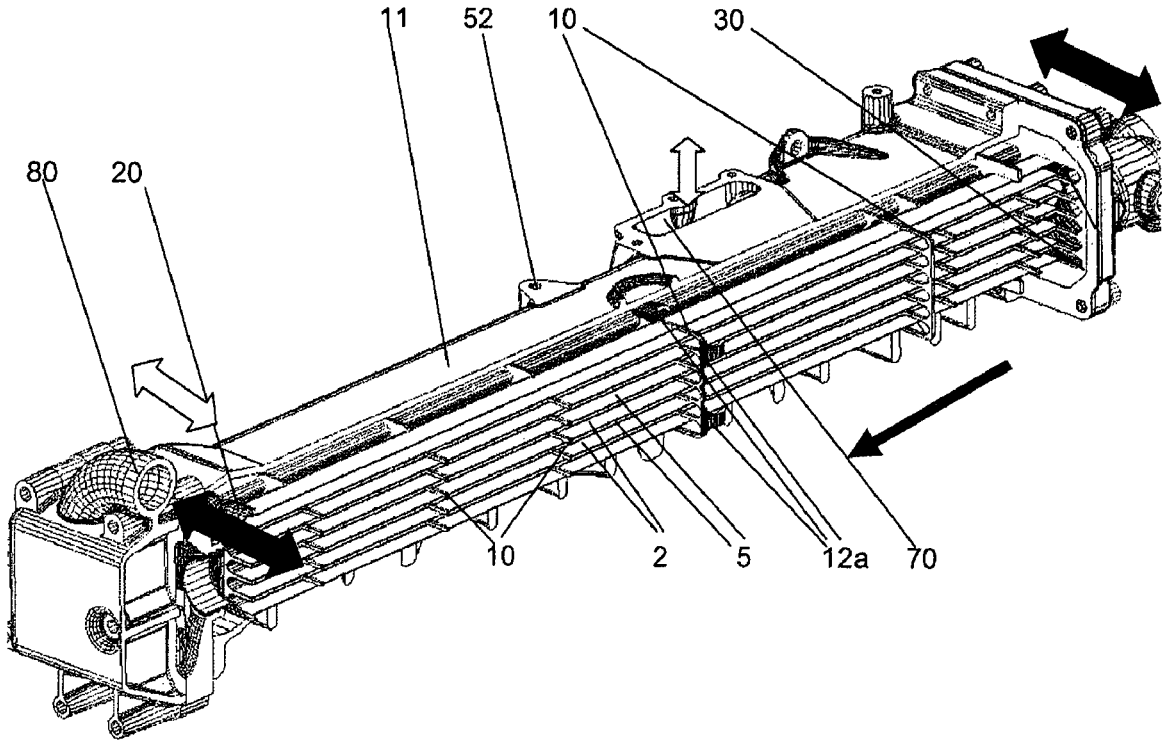
FIG. 1 shows a perspective view of a cut open exhaust gas heat exchanger.

The block arrows in FIG. 1 indicate the direction of flow through the exhaust gas heat exchanger, with the black block arrows being intended to symbolize the exhaust gas and the block arrows without filling symbolizing the cooling fluid flow. The illustration as doubled block arrows is intended to indicate that the media can flow through the exhaust gas heat exchanger in either a parallel flow manner or in a counter flow manner. Corresponding inlets and outlets 80, 70 are provided. The corresponding arrows in FIGS. 1 and 2 which point in the longitudinal direction of the heat exchanger show the insertion direction of the tube bundle into the housing 11.

The tube bundle of the heat exchanger includes a plurality of tubes 2 which are formed as drawn flat tubes 2 in the exemplary embodiment. In the illustrated embodiment, each flat tube 2 contains a turbulator 3. In each case a coolant duct 5, which can be equipped with flow directing elements, can be arranged between two flat tubes 2. No such elements are shown in the figures, but the coolant ducts 5 are of rather flat design. In the exemplary embodiments, two rows 2.1 and 2.2 of flat tubes 2 have been provided. As is apparent from FIG. 4, there are six flat tubes 2 in each row.

The tube bundle in FIG. 1 has a plurality (i.e., five) of grid-like metallic securing devices 10, with just one of them (in the exemplary embodiment) having been equipped integrally therewith with sprung hook-shaped protrusions 12 which are arranged on opposite sides of the securing device 10 or of the tube bundle. Depending on the length of the heat exchanger and/or according to other influencing factors, a corresponding selection of securing devices 10 can be embodied integrally with sprung hook-shaped protrusions 12. Instead of one-piece hook-shaped protrusions 12 it is also possible to provide springs 12*b* or the like as individual parts which are to be attached to the securing devices 10 in a frictionally and/or positively locking fashion.

Figure 2:
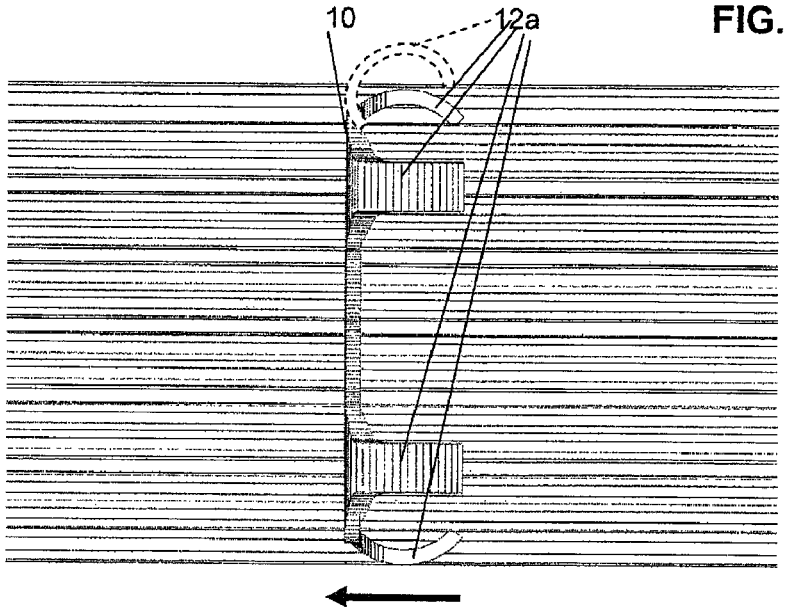
FIG. 2 is a detailed view showing a piece of the tube bundle with a securing device.
Figure 3:
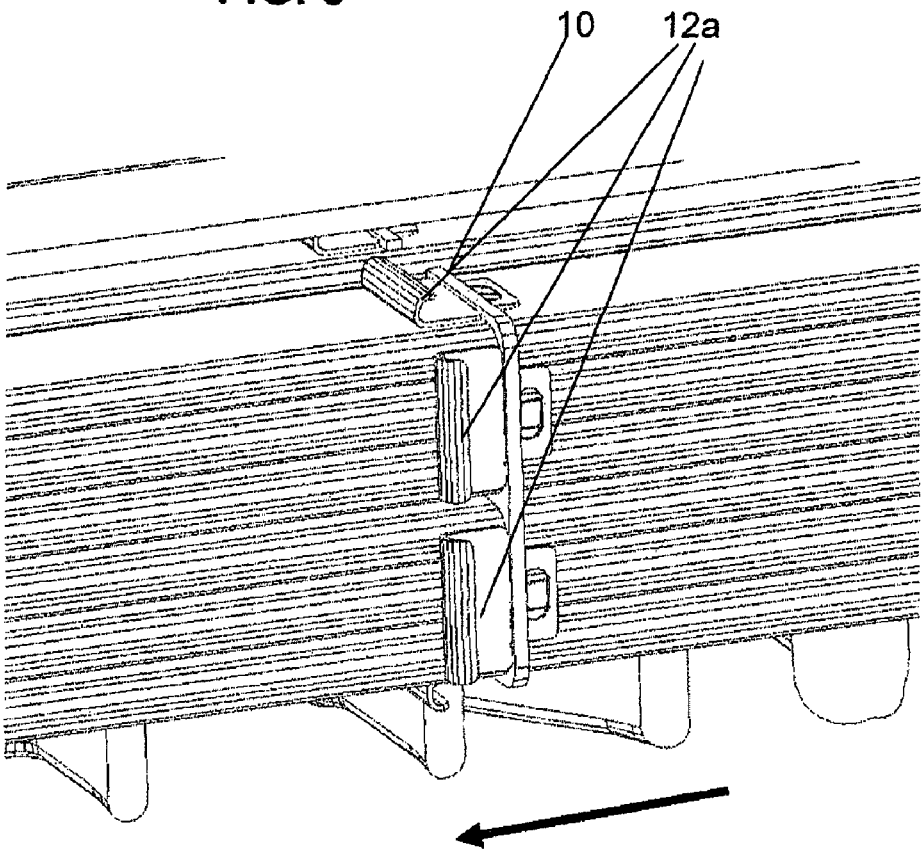
FIGS. 3 and 4 are similar to FIG. 2 but with modified securing devices.
Figure 4:
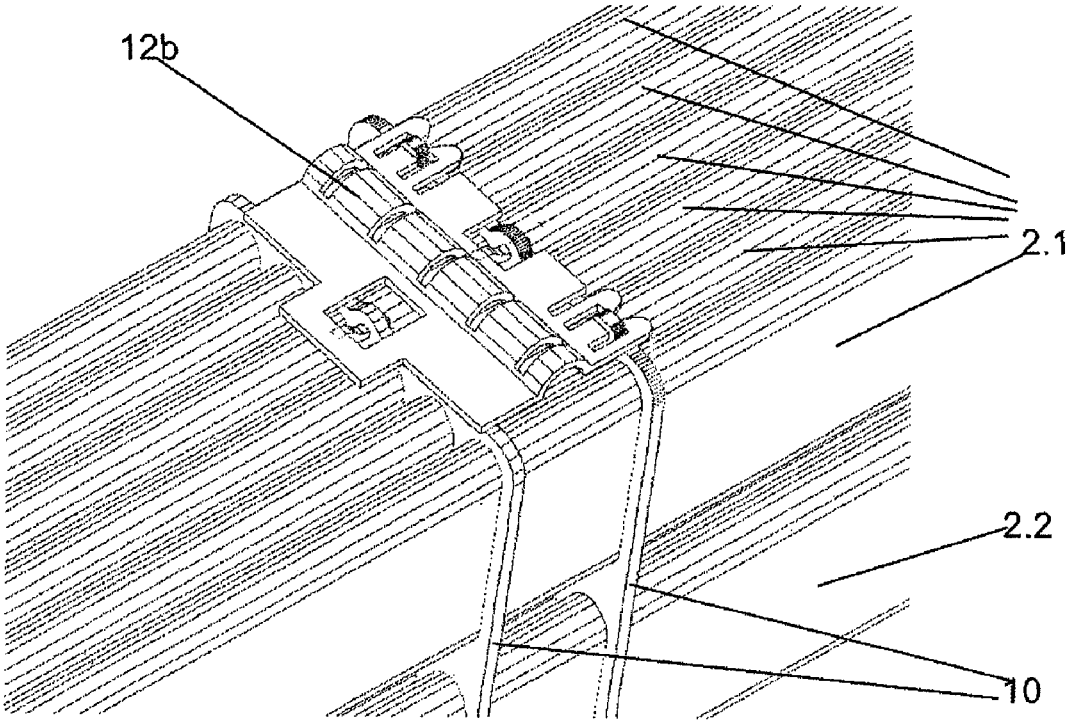

Two exemplary embodiments which show sprung, metallic hook-shaped protrusions 12 as individual parts, which are attached in a frictionally and positively locking fashion to grid-like, metallic securing devices 10, have been represented in FIGS. 3 and 4. From the figures, in particular from FIG. 2, it is also clear that the sprung, metallic hook-shaped protrusions 12 are deformed in the opposite direction to the insertion direction in order to facilitate the insertion.

In FIG. 2, the position of the hook-shaped protrusions 12 before insertion into the housing 11 which is not shown there was indicated in a basic fashion using the example of a single hook-shaped protrusion 12 by dashed lines. The hook-shaped protrusions 12 are arranged on opposite sides. The hook-shaped protrusions 12 therefore protrude somewhat further from the virtual center of the heat exchanger and are forced, as the tube bundle is inserted into the housing 11, during which process they move in a sprung fashion toward the center and undergo a change in shape which occurs within the elastic region. The spring force of the hook-shaped protrusions 12, which is built up in the process, then acts against the housing wall and ensures, through interaction with the hook-shaped protrusions 12, which are arranged on opposite sides, that there is a corresponding reduction in the vibrations which occur during operation of the heat exchanger, for example in a motor vehicle.

Irrespective of whether hook-shaped protrusions 12 are provided or not, the grid-like securing devices 10 can, for example, be in two parts, with the parts being pushed in a comb-like fashion from opposite sides over the flat tubes 2 or being pushed in one part and then from one end of the tube bundle in its longitudinal direction as far as the position provided. The grid rods are intended at any rate to extend through the coolant duct 5.

A tube plate 30 and a collecting box for a diffuser 31 are fitted on both ends of the tube bundle. The diffuser 31 changes the geometry on the exhaust gas side from a four corner shape at the tube plate 30 into a round shape at the connecting flange 60 (see below). One or more of the aforementioned components can be manufactured from stainless steel. The described structure can be connected to form one physical unit in a hard soldering process. However, when springs or the like are provided as individual parts they can also be attached to the securing device 10 after the soldering.

The soldered physical unit can then be inserted into a housing 11 (with the diffuser 31 at the front) in the insertion direction indicated by the aforementioned arrow, and can be completely mounted.

The housing 11 can be a cast structure made of aluminum. It can have a connecting flange 60 for the exhaust gas which is dimensioned in such a way that the diffuser 31 which is soldered onto the tube bundle by means of a tube plate 30 fits and is received therein. In addition, a groove 61 can be formed in which an elastic sealing ring or some other suitable seal 62 can be located (see FIGS. 7 and 8).

Figure 7:
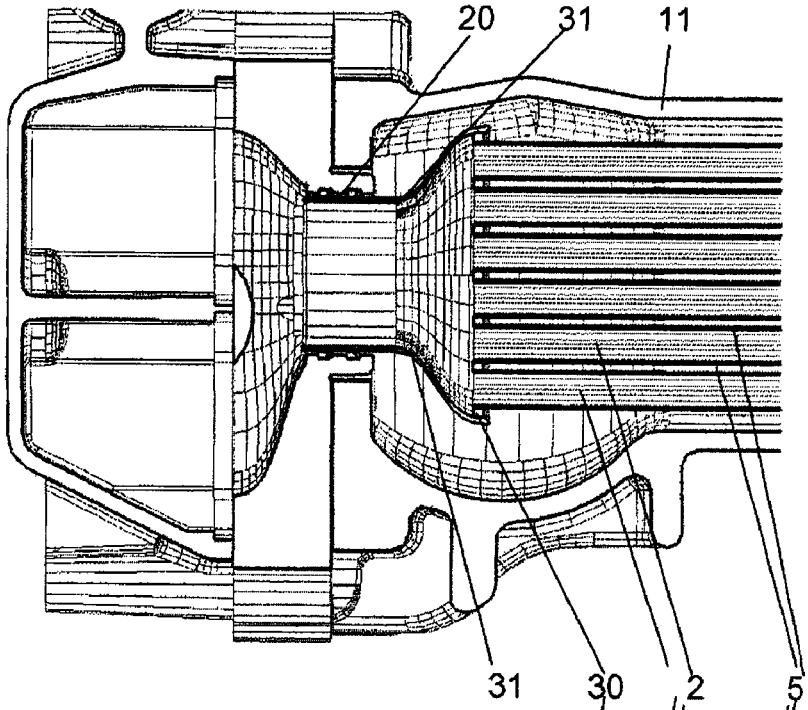
FIGS. 7-10 show details of the heat exchanger in the region of the elastic device.
Figure 8:
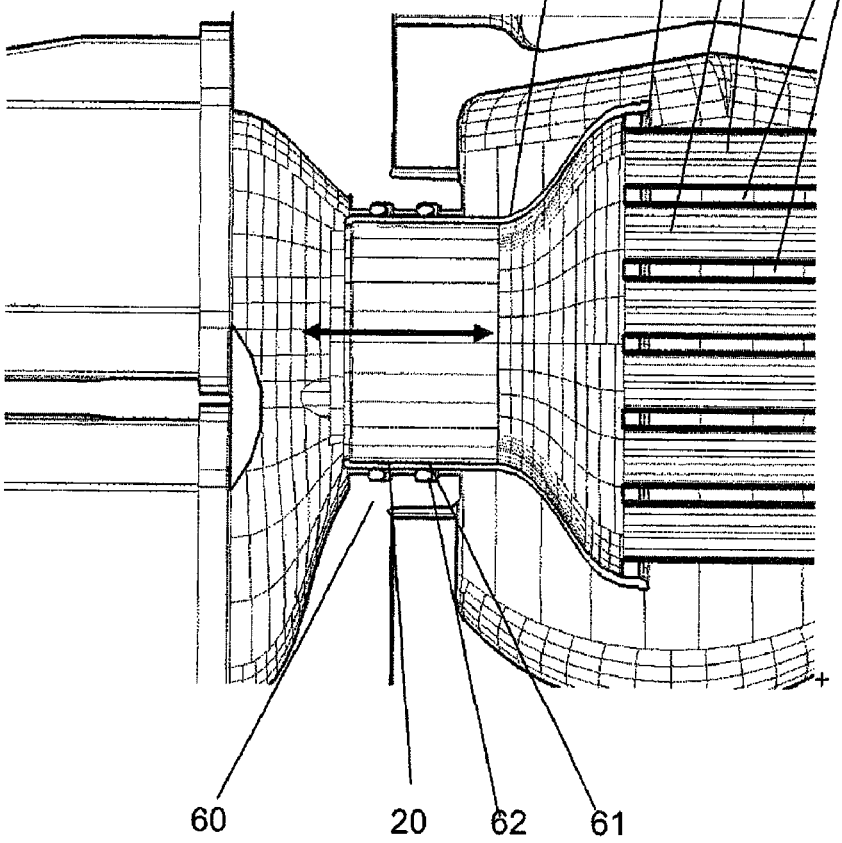
Figure 9:
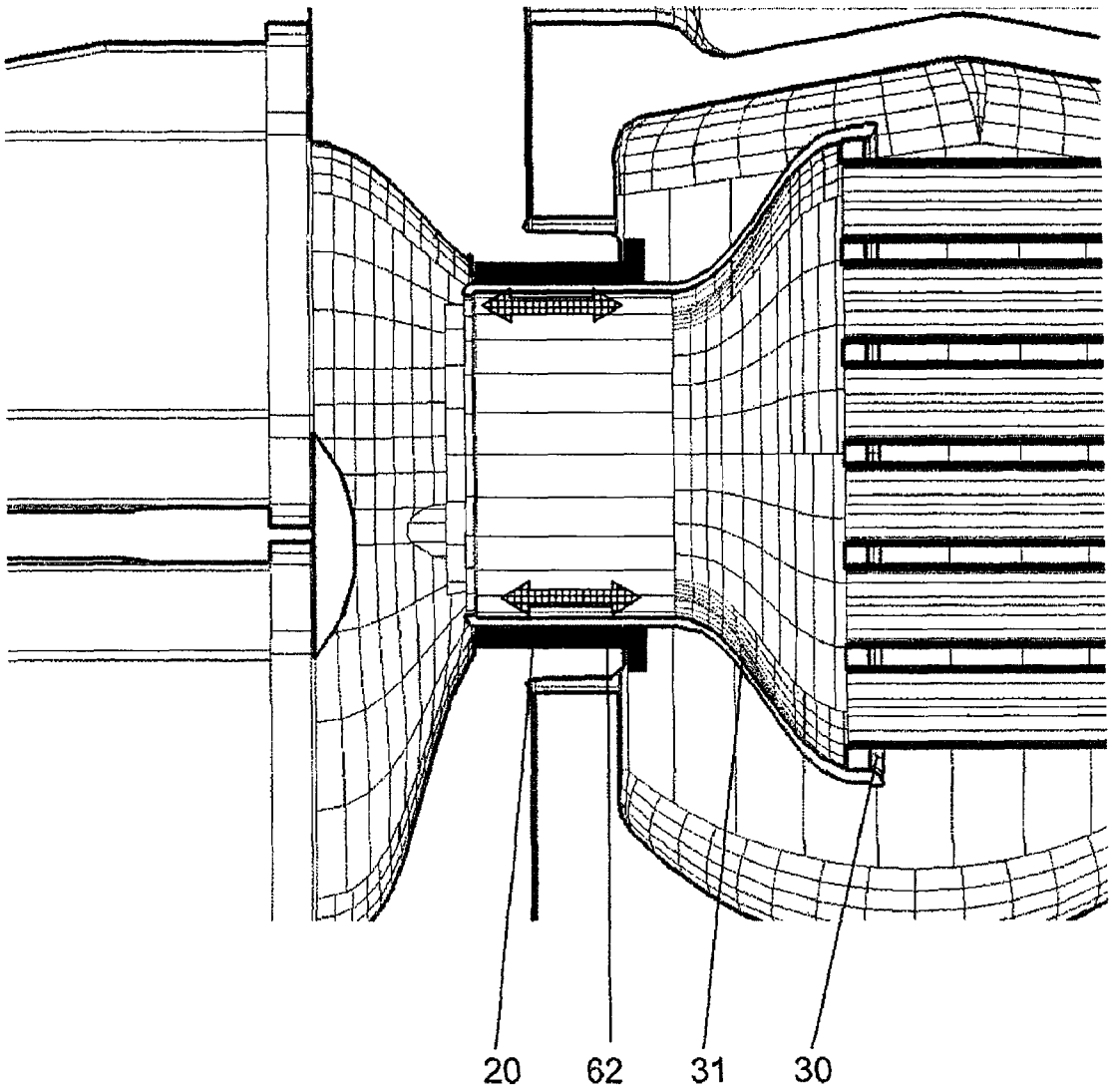

FIG. 8 shows an enlarged detail from FIG. 7. From this illustration it is clear that changes in length caused by changes in temperature can be compensated for by permitting movements in the longitudinal direction of the tube bundle or of the housing 11. The two doubled block arrows in FIG. 9 are intended to indicate this. In FIG. 9, in order to form the elastic properties of the device 20, the entire annular gap region between the diffuser 31 and the connecting flange 60 has been provided with an elastic rubber ring 62 or the like—instead of the two O-rings 62 in the groove 61 according to FIGS. 7 and 8. Here, improved elastic properties can be expected. The existing annular gap can be somewhat larger here, viewed in the radial direction, than in the exemplary embodiment according to FIGS. 7 and 8.

The formation of sliding seats which are present in the prior art and in which metal is usually slid on metal is avoided by means of this proposal, with the aim of improving the vibration behavior of the heat exchanger. As is shown further by FIG. 8, a ring shaped gap which is still visible there but is actually smaller still remains there between the end of the diffuser 31 and the flange 60 in order to make use of the elastic properties of the O-rings 62 for vibration damping.

A further flange 50, to which the tube plate 30 of the tube bundle and a further exhaust gas collecting box 51 have been attached, has been formed at the other end of the housing 11. In addition, connectors 52 are formed on the housing 11 in order to be able to attach the exhaust gas heat exchanger to a connecting structure (not shown). Finally, connectors 70 have also been provided on the housing 11 in order to allow the coolant to flow in and out of the coolant ducts 5 of the tube bundle.

Figure 5:
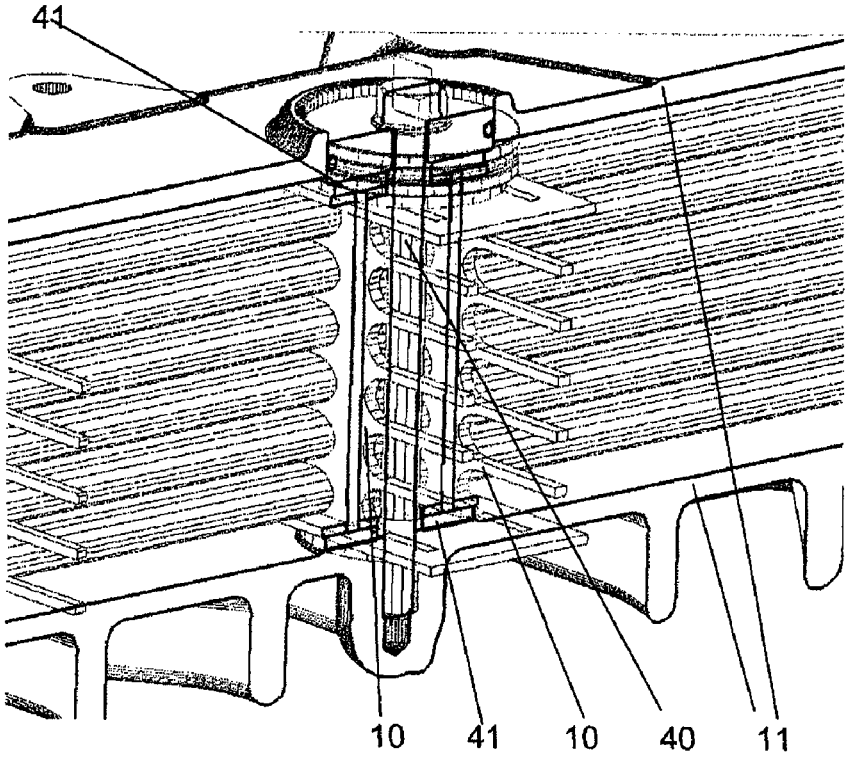
FIGS. 5 and 6 are detailed views of the heat exchanger with a clamping device.
Figure 6:
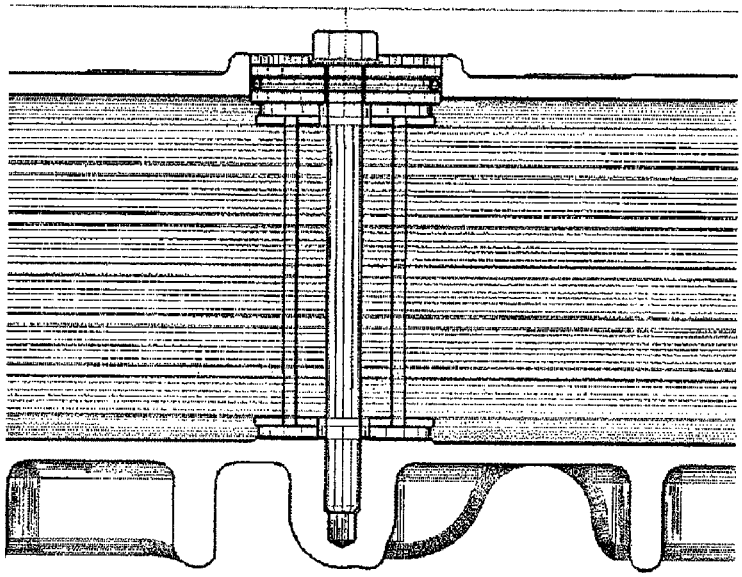

FIGS. 5 and 6 show that similar effects can also be achieved by the use of one (or more) clamping elements 40 which can replace the sprung metallic hook-shaped protrusions 12 or the springs or the like, but could also supplement them. The clamping element 40 can be a bolt which extends through the bundle between the tubes 2 and connects housing walls lying opposite. Rubber rings 41 or the like can be inserted in order to damp the vibrations.

Figure 10:
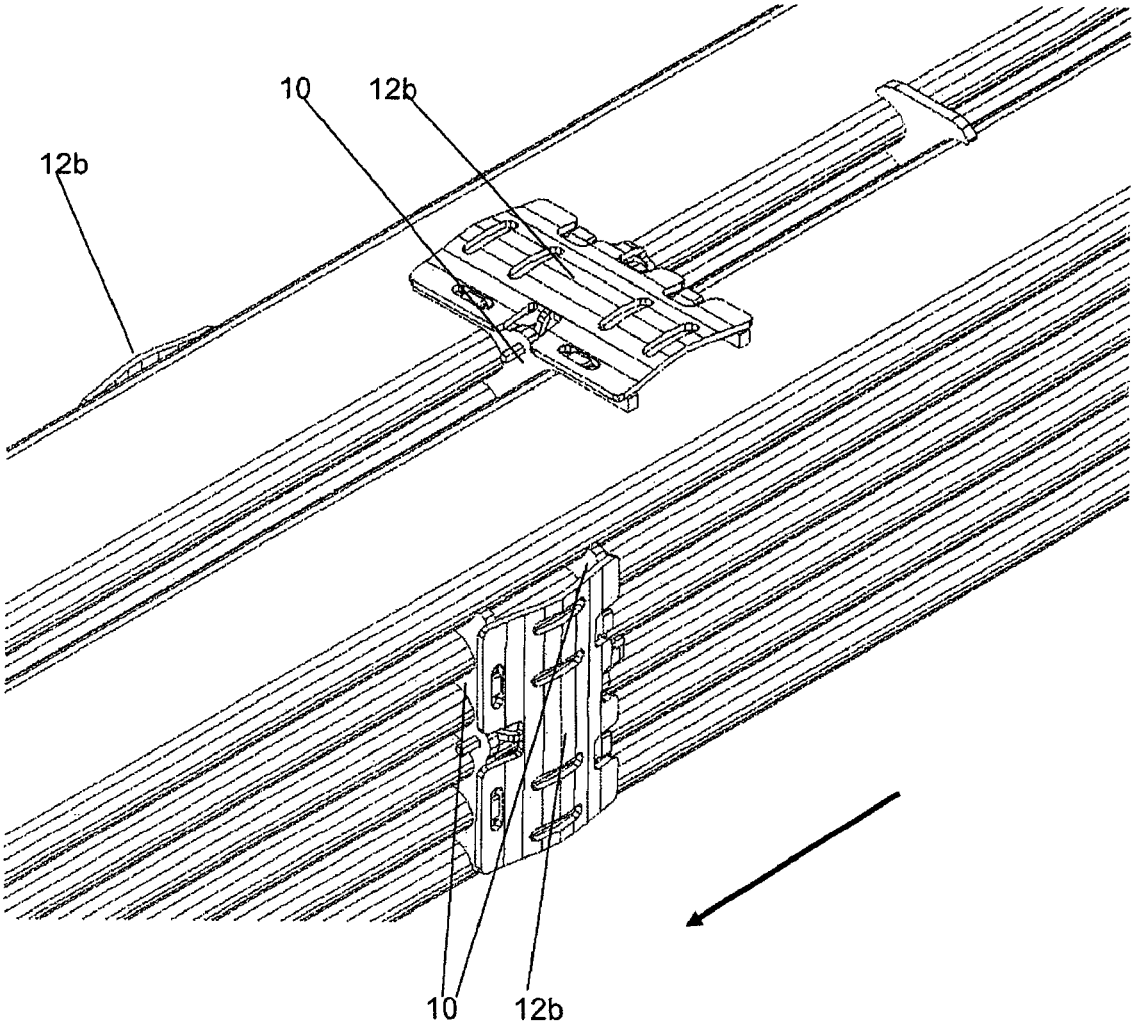

FIG. 10 shows curved springs 12*b* or similar elements which are attached between two grid-like, metallic securing structures 10. The curvature is also embodied here in such a way that the insertion process can be carried out, during which process the springs 12*b* yield elastically. As is shown by FIG. 10, the springs 12*b* which are arranged on opposite sides can also be arranged in an offset fashion, i.e. all four springs do not need to lie in one plane which passes through the tube bundle.

It has become apparent that the present invention can allow the vibrations of the tube bundle in the housing to be overcome in such a way that fractures and/or noise caused by them are avoided and/or substantially reduced.

The embodiments described above and illustrated in the figures are presented by way of example only and are not intended as a limitation upon the concepts and principles of the present invention. As such, it will be appreciated by one having ordinary skill in the art that various changes are possible.

What is claimed is:

1. A heat exchanger comprising:

a bundle of tubes inserted into a tubular housing, wherein exhaust gas flows through the tubes;

an elastic element permitting differences in thermal expansion in a tube-axial direction between the bundle of tubes and the tubular housing;

a coolant duct arranged between the tubes, wherein the bundle of tubes includes at least one grid-like securing structure which supports the bundle in the housing; and a plurality of metallic springs attached in at least one of a positively locking and frictionally locking fashion to the grid-like securing structure, each of the springs including a planar section extending in the tube-axial direction and disposed against a surface of the tubes and an outwardly curved section joined to and extending from the planar section, spring force of the springs being directed against the housing in order to reduce transmission of vibrations.

2. The heat exchanger of claim 1, wherein the bundle is a stainless steel soldered structure, and wherein the housing is formed of aluminum and is a cast part into which the bundle is inserted with tube plates, which are provided on the tube ends, and a diffuser.

3. The heat exchanger of claim 2, wherein the housing includes a connecting flange which is matched to the diffuser, and wherein the elastic element provides an elastic seal and an annular gap between the diffuser and the connecting flange.

4. The heat exchanger of claim 3, wherein the elastic seal is one of arranged in a groove and substantially fills an annular gap region between the diffuser and connecting flange.

5. The heat exchanger of claim 1, wherein the tubes are one of flat tubes formed of pairs of plates, manufactured from a sheet metal strip and welded along a longitudinal seam, and drawn flat tubes.

6. The heat exchanger of claim 5, wherein the flat tubes can be arranged in a plurality of rows.

7. The heat exchanger of claim 1, wherein the grid-like securing structure is in one of one part and a plurality of parts.

8. The heat exchanger of claim 1, wherein the springs are attached in a positively locking fashion to the grid-like securing structure.

9. The heat exchanger of claim 1, wherein the springs are attached in a frictionally locking fashion to the grid-like securing structure.

10. The heat exchanger of claim 1, wherein the springs are attached to the grid-like securing structure to prevent movement relative to the bundle of tubes along an axis of the bundle of tubes and transverse to the axis.

11. The heat exchanger of claim 1, wherein the plurality of metallic springs includes a first spring and a second spring is spaced from the first spring.

12. The heat exchanger of claim 11, wherein the first spring and the second spring are separately attached to the grid-like securing structure.

13. The heat exchanger of claim 1, wherein the bundle of tubes has a first side and a different second side, the plurality of springs includes a first spring is arranged on the first side of the bundle of tubes, and wherein a second spring is arranged on the second side of the bundle of tubes.

14. The heat exchanger of claim 13, wherein the first spring and the second spring are substantially in a plane extending transversely through the bundle of tubes.

15. A heat exchanger comprising:

a bundle of tubes inserted into a tubular housing, wherein exhaust gas flows through the tubes in a tube-axial direction, wherein the bundle of tubes has a first side and a different second side;

a coolant duct arranged between the tubes, wherein the bundle of tubes includes at least one grid-like securing structure which supports the bundle in the housing; and a plurality of metallic springs attached to the bundle of tubes to prevent relative movement therebetween in the tube-axial direction, spring force of the springs being directed against the housing in order to reduce transmission of vibrations;

wherein the plurality of metallic springs includes a first spring including a first planar section disposed against the first side of the bundle of tubes and a first outwardly curved section joined to and extending from the first planar section , wherein the plurality of metallic springs includes a second spring including a second planar section disposed against the second side of the bundle of tubes and a second outwardly curved section joined to and extending from the second planar section, and wherein the first spring and the second spring are substantially in a plane extending transversely through the bundle of tubes.

16. The heat exchanger of claim 15, wherein the plurality of metallic springs are attached in a positively locking fashion to the grid-like securing structure to thereby attach the springs to the bundle of tubes.

17. The heat exchanger of claim 15, wherein the plurality of metallic springs are attached in a frictionally locking fashion to the grid-like securing structure to thereby attach the springs to the bundle of tubes.

18. The heat exchanger of claim 15, wherein the plurality of metallic springs are attached to the bundle of tubes to prevent relative movement therebetween in at least one direction transverse to the tube-axial direction.

19. The heat exchanger of claim 15, wherein the first spring and the second spring are individually attached to the bundle of tubes.

20. The heat exchanger of claim 15, wherein the bundle is a stainless steel soldered structure, and wherein the housing is formed of aluminum and is a cast part into which the bundle is inserted with tube plates, which are provided on the tube ends, and a diffuser.

21. The heat exchanger of claim 15, wherein the grid-like securing structure is in one of one part and a plurality of parts.

22. The heat exchanger of claim 15, wherein the grid-like securing structure has a thickness in the tube-axial direction, the first planar section is longer in the tube-axial direction than the thickness, and the second planar section is longer in the tube-axial direction than the thickness.

23. The heat exchanger of claim 15, wherein the first side is adjacent to the second side.

24. The heat exchanger of claim 15, wherein the first side is perpendicular to the second side.

25. The heat exchanger of claim 1, wherein the grid-like securing structure has a thickness in the tube-axial direction and the planar section is longer in the tube-axial direction than the thickness.

26. The heat exchanger of claim 13, wherein the first side is adjacent to the second side.

27. The heat exchanger of claim 13, wherein the first side is perpendicular to the second side.

* * * * *

UNITED STATES PATENT AND TRADEMARK OFFICE

CERTIFICATE OF CORRECTION

PATENT NO. : 8,033,323 B2
APPLICATION NO. : 11/764491
DATED : October 11, 2011
INVENTOR(S) : Harald Schatz et al.

It is certified that error appears in the above-identified patent and that said Letters Patent is hereby corrected as shown below:

| | |
|---|---|
| Claim 11, Column 6, line 12: | Delete the word "is" |
| Claim 13, Column 6, line 19: | Delete the word "is" |
| Claim 13, Column 6, line 20: | Delete the word "wherein" |
| Claim 13, Column 6, line 20: | Delete the word "is" |

Signed and Sealed this
Twenty-second Day of November, 2011

David J. Kappos

David J. Kappos
*Director of the United States Patent and Trademark Office*